United States Patent [19]

Vollmar

[11] Patent Number: 4,487,145

[45] Date of Patent: Dec. 11, 1984

[54] PRESSER FOOT DRIVE LINKAGE IN A SEWING MACHINE

[75] Inventor: Kurt Vollmar, Weilerbach, Fed. Rep. of Germany

[73] Assignee: Pfaff Industriemaschinen GmbH, Fed. Rep. of Germany

[21] Appl. No.: 404,335

[22] Filed: Jul. 30, 1982

[30] Foreign Application Priority Data

Aug. 13, 1981 [DE] Fed. Rep. of Germany ..... 3132044

[51] Int. Cl.[3] ..... D05B 27/04; D05B 29/02

[52] U.S. Cl. ..... 112/320; 112/235

[58] Field of Search ..... 112/320, DIG. 3, 235, 112/323, 312, 313, 314, 321

[56] References Cited

U.S. PATENT DOCUMENTS

| | | | |
|---|---|---|---|
| 3,570,427 | 3/1971 | Wenz | 112/320 |
| 3,583,344 | 6/1971 | Meier | 112/320 |
| 3,614,934 | 10/1971 | Wenz et al. | 112/320 |
| 3,757,714 | 9/1973 | Gustmann et al. | 112/320 |
| 3,927,629 | 12/1975 | Vollmar | 112/320 |
| 4,067,275 | 1/1978 | Willenbacher | 112/320 |

FOREIGN PATENT DOCUMENTS

| | | |
|---|---|---|
| 90984 | 4/1896 | Fed. Rep. of Germany . |
| 2938894 | 10/1981 | Fed. Rep. of Germany . |

*Primary Examiner*—Werner H. Schroeder
*Assistant Examiner*—Andrew M. Falik
*Attorney, Agent, or Firm*—McGlew and Tuttle

[57] ABSTRACT

A sewing machine includes a presser foot which is driven on a main shaft by an eccentric drive which drives through a toggle mechanism to a crank lever driver which effects the raising of the presser foot synchronously with the upward movement of a sewing machine needle so as to release a workpiece for movement relative to the needle. The presser foot is biased downwardly by a spring which may be adjusted as to its tension. During a sewing operation a driver is moved to a position only slightly disengaged from the lifting surface of the presser foot and during periods of engagement of the presser foot with the workpiece the toggle mechanism ensures that the presser foot engages the workpiece gently, irrespective of the adjusted amount of total lift of the presser foot by the drive mechanism.

12 Claims, 4 Drawing Figures

29
30
28
31
6
7
8
1
3
2
27
26
25
23
4
33
32
9
24
11
22
10
21
5
12
16
38
13
15
14
20
18
17
19
37
36
35
39
34

PRESSER FOOT DRIVE LINKAGE IN A SEWING MACHINE

FIELD AND BACKGROUND OF THE INVENTION

This invention relates in general to sewing machines and in particular to a new and useful mechanism for raising and lowering a presser foot in relation to a workpiece of a sewing machine.

In a prior art presser foot arrangement for a sewing machine (German Pat. No. 629 393), a cam eccentric acts on a stop secured to the presser foot construction. Because of the friction produced between the spring loaded stop of the presser foot and the eccentric, the wear is so high that the known arrangement is prevented from being employed in high speed machines.

SUMMARY OF THE INVENTION

The invention is directed to a simple, low-wear drive for the vertical movement of the presser foot, having the advantage of a gentle engagement and disengagement between the presser foot and the work and, in addition, permitting the adjustment of the total stroke of the presser foot.

In accordance with the invention, a presser bar for a presser foot is mounted for vertical movement in a bushing of a fixed plate of the sewing machine and its vertical position may be adjusted initially by a control such as an air cylinder which moves the piston to position the presser bar and a presser foot associated therewith into association with the workpiece. The presser foot includes a guide rod portion which is guided in a hollow portion of the presser bar and is biased downwardly by the force of a spring which may be adjusted. In order to raise and lower the presser bar during the operation of the sewing machine an eccentric drive from the main shaft of the sewing machine is connected to periodically oscillate a crank lever drive member which has a drive surface which engages a stop surface of the presser foot to raise it from the workpiece which moves away from the stop surface to permit the downward biasing pressure by the spring of the presser foot against the workpiece as necessary during the sewing operation. In the inventive arrangement the driver bar is connected for oscillatory movement through a toggle linkage which is arranged so that it is in extended position when the presser foot is engaged with the workpiece. The construction is such that the impact speed within the necessary idle stroke connection between the lifting element of the driver member and the presser foot as well as the needed slide motion are thereby substantially reduced in the operation of the sewing machine.

Accordingly it is an object of the invention to provide an improved sewing machine wherein a presser foot is engaged with a workpiece by spring biasing and wherein a drive for the workpiece to raise it from the workpiece during reciprocation of the needle comprises a toggle mechanism which is extended when the presser foot is engaged with the workpiece which effects an initially gentle and then rapid rise of the presser foot during its disengagement phase.

A further object of the invention is to provide a presser foot operating construction for a sewing machine which is simple in design, rugged in construction and economical to manufacture.

DESCRIPTION OF THE PREFERRED EMBODIMENTS

Figure 1:
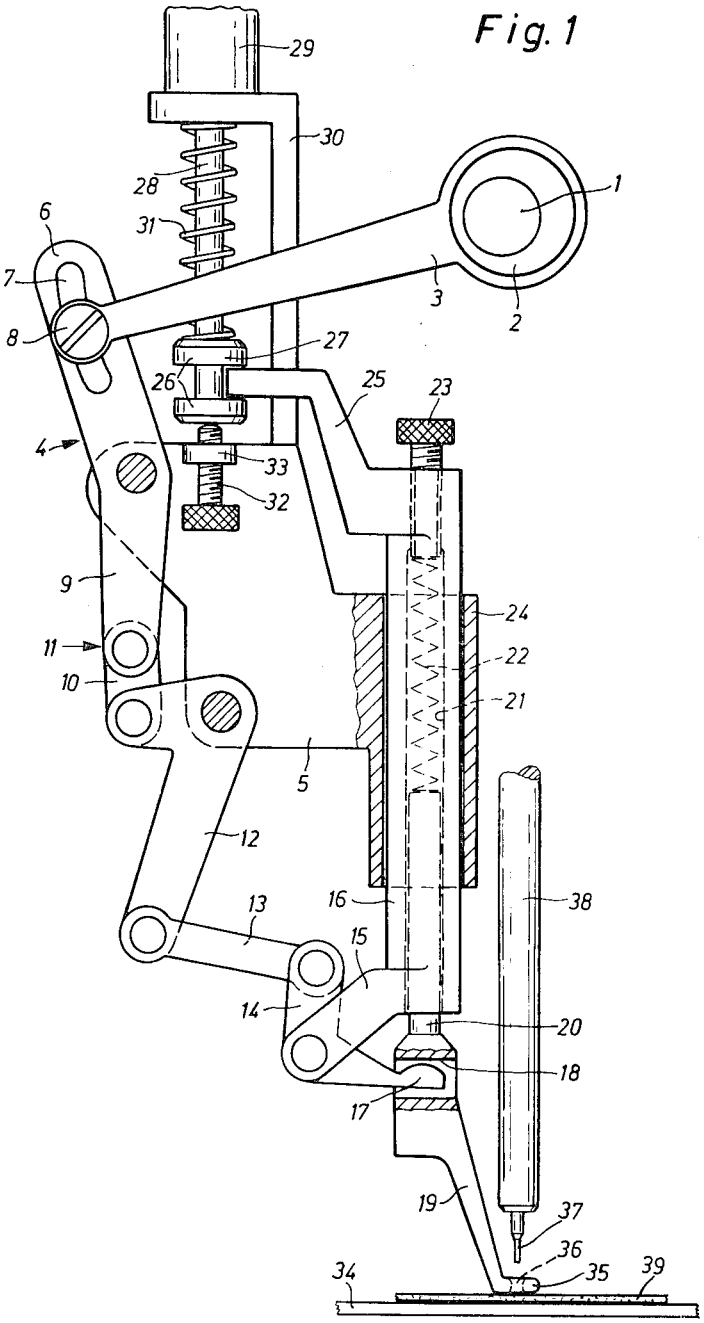
FIG. 1 of the drawings is a partial side elevational view and sectional view of a portion of sewing machine having a presser foot construction in accordance with the invention.

Referring to the drawings in particular the invention embodied therein comprises a presser foot operating mechanism for a sewing machine having a main shaft 1 to reciprocate a needle 37 carried by a needle bar 38. The construction includes a support plate 5 having a bushing portion 24 in which a hollow presser bar 16 is mounted for upward and downward movement. Presser foot 19 has a guide rod portion 20 which extends into the hollow portion of the bar 16 and moves upwardly and downwardly therein. The presser foot 19 has a stop surface 18 which is engageable by a driver surface 17 of a crank lever driver 14 which is pivoted to an extension 15 of the presser bar 16. Actuator means in the form of a air cylinder 29 having a movable piston 28 is effective to move the presser bar 16 through stop elements 26 defining an engagement member 27 which engage on respective sides of an arm 25 of the presser bar 16. A double armed lever or swing lever 4 is pivotally mounted on a support plate 5 of the sewing machine and it is driven by an eccentric 2 from the main shaft 1 so as to oscillate backwardly and forwardly and to oscillate the crank lever 14 through a toggle mechanism generally designated 11.

The main shaft 1 is mounted in the housing of a sewing machine. Through the eccentric 2 and eccentric bar 3, shaft 1 drives the double armed lever 4 which is mounted on a plate 5 firmly secured to the housing. One arm 6 of the double armed lever 4 is provided with an oblong arcuate slot 7 within which the hinge point of the eccentric bar 3 can be fixed by means of a collar screw 8. Another arm 9 of the double armed lever forms, along with a link 10, the toggle mechanism 11 which is connected to an angle lever 12 also pivotably mounted on plate 5. An angle lever 12 is connected through a substantially horizontally extending link 13 to the crank lever 14 which is mounted on an extension 15 of presser bar 16. Crank lever 14 is provided with a spherically rounded driver 17 projecting under the stop surface 18 of a presser foot 19. Presser foot 19 comprises a guide rod 20 which is guided in a bore 21 of presser bar 16 and loaded by a spring 22. The pressure of spring 22 can be adjusted by a set of screws 23 which is screwed from above into the upper end portion of presser bar 16.

Presser bar 16 is mounted for displacement in a bushing 24 which is firmly connected to plate 5, and has an arm 25 whose free end projects between stops 26 of an engaging member 27. Engaging member 27 is secured to a piston rod 28 of an air cylinder 29 which is supported by a holder 30 firmly connected to plate 5. With air cylinder 29 vented, a compression spring 31 surrounding piston rod 28 urges the engaging member 2 against a set screw 32 which is screwed into an extension 33 of plate 5 and forms stop means for the presser bar.

Presser foot 19 comprises a presser sole 35 which cooperates with a bed plate 34 of the sewing machine and is provided with a passage hole 36 for a needle 37. Needle 37 is secured to a needle bar 38 which is driven by main shaft 1 in a manner known per se (not shown). The needle cooperates with a rotary hook (not shown) which is mounted beneath bed plate 34, to produce a seam in a workpiece 39 placed on the bed plate.

During a sewing operation, engaging member 27 secured to piston rod 28 is pressed by spring 31 against set screw 32, so that presser bar 16 occupies a predetermined position, since its arm 25 is engaged with the member 27. Also, presser foot 19 is pressed by spring 22 downwardly.

At every turn of main shaft 1, eccentric 2 causes a pivotal motion of driver 17 of crank lever 14, which is effected through the connection: Eccentric bar 3, double armed lever 4, link 10, angle lever 12, link 13, and crank lever 14. Driver 17 is thereby pivoted from its upper position downwardly. Right before needle 37 penetrates into passage hole 36 of presser foot 19, driver 17 disengages from surface 18 so that under the action of spring 22, sole 35 of the presser foot is applied against the work. Along with the rotary hook (not shown) and in a well known manner, the needle produces a stitch and is then moved upwardly again. As soon as the point of needle 37 has passed through hole 36, eccentric 2, again through the above described linkage, causes an upward pivotal movement of stop surface 18, so that presser foot 19 is lifted. Then, within the period up to the next sewing cycle, the work can be advanced.

Since with the driver 17 lowered, toggle mechanism 11 is in its extended position, the motion of driver 17 from its lowermost position upwardly is initially slow, yet accelerates toward the uppermost position thereof.

Consequently, from its position of engagement with the work, presser foot 19 is moved initially relatively very slowly, while it is moved very quickly in the zone of its maximum lift, so that a satisfactory elevation from the work is obtained.

Figure 2:
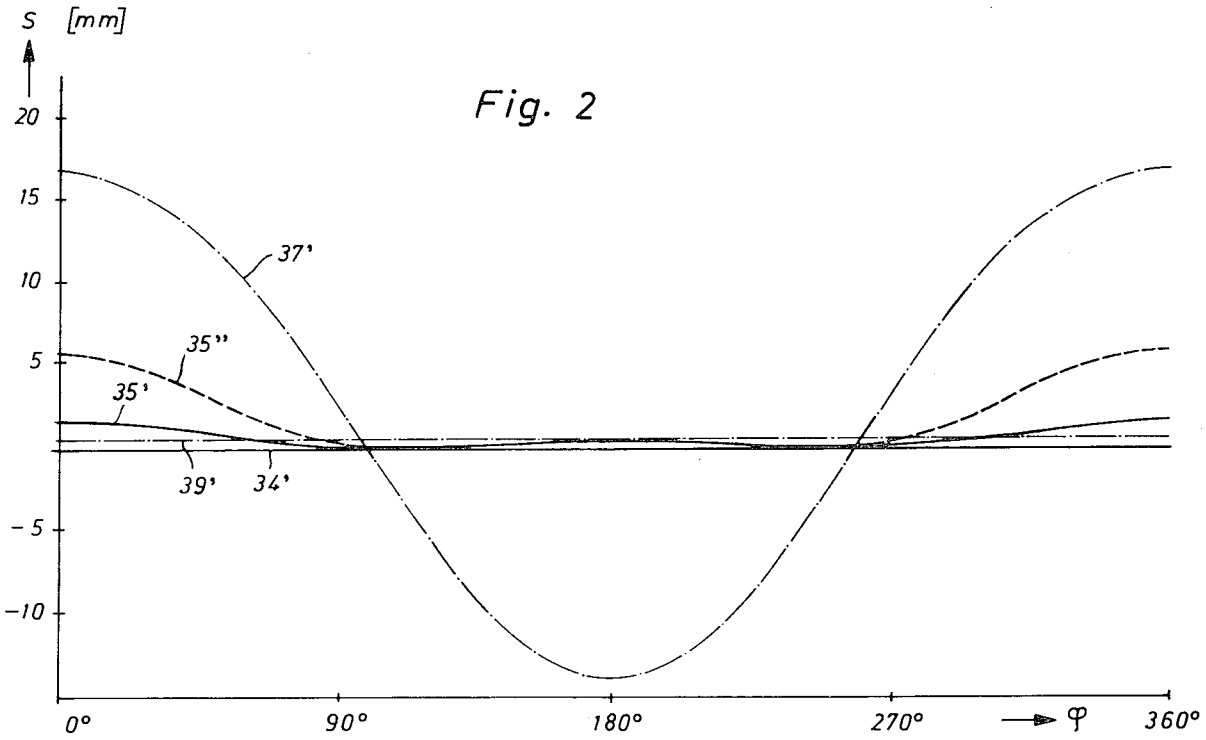
FIG. 2 is a diagram indicating the motions of the needle point and the presser sole during the various angles of rotation of the main shaft of the sewing machine.
Figure 3:
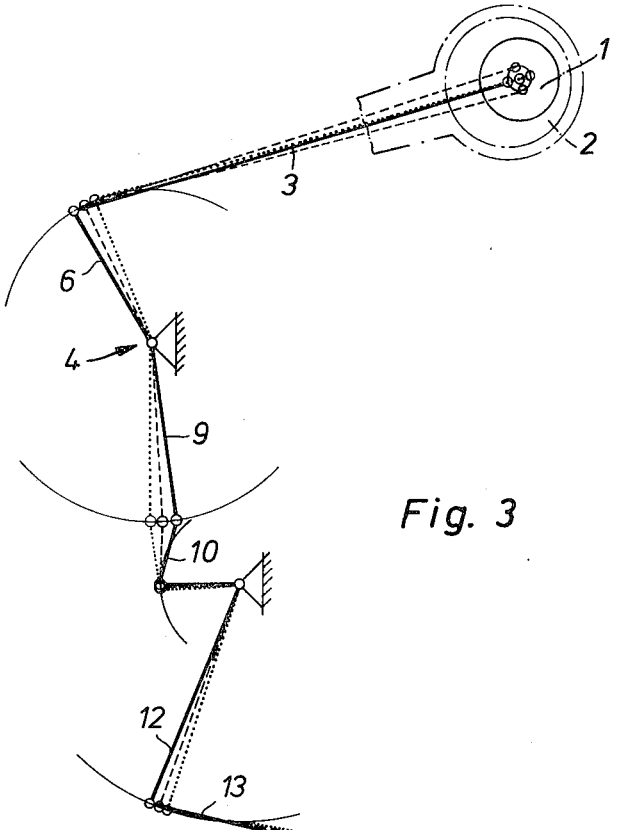
FIG. 3 is a schematic representation of the structure shown in FIG. 1, in three positions, with the solid line position showing the structure with the presser foot fully raised, the dashed line position showing the structure with the presser foot in an intermediate position and the dotted line position showing the structure with the presser foot in a lower most position.
Figure 4:
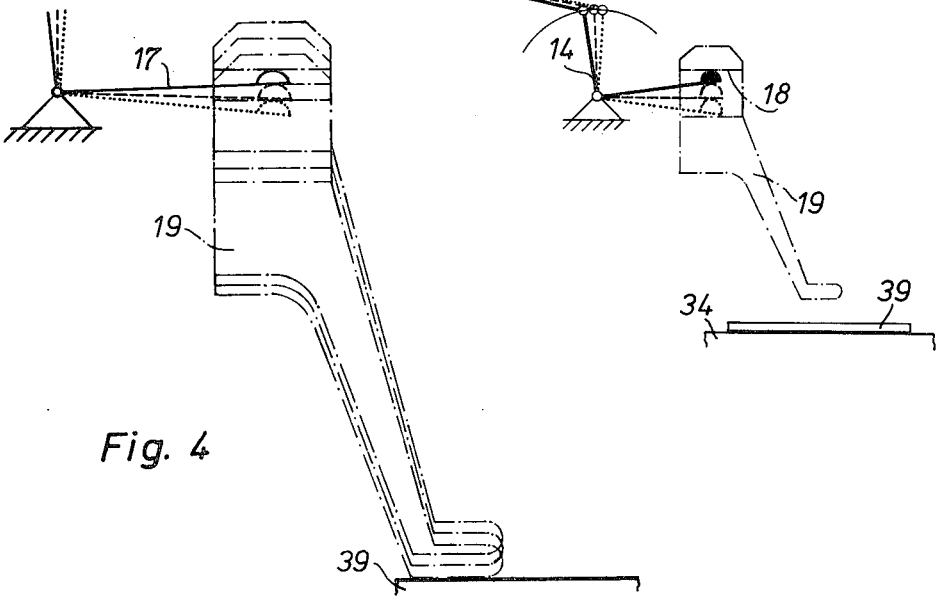
FIG. 4 shows the presser foot and driver in the three positions of FIG. 3.

In FIG. 2, the motion of needle 37 and presser sole 35 are plotted against the angle of rotation of main shaft 1. The curve of motion of the point of needle 37 is shown at 37'. Line 34' represents the surface of bed plate 34 and line 39' indicates the surface of the work 39. Curves 35' and 35'' which result from measurements, show how the underside of presser sole 35 moves during a single turn of main shaft 1 if no work 39 is present. Curve 35' shows the movement for an adjusted minimum lift of the presser foot 19, while curve 35'' shows such movement for an adjusted maximum presser foot lift.

This amount of lift is adjusted by displacing the hinge point of eccentric bar 3, in oblong slot 7. Within the range where curves 35', 35'', pass below the indicated surface 39' of work 39, presser sole 35 pass below the indicated surface 39' of work 39, presser sole 35 applies against the work 39 which is normally present, and driver 17 is disengaged by the corresponding amount from stop surface 18.

It is evident from the variation of curves 35', 35'' that during the period needle 37 is piercing the work, both these curves 35', 35'' are very flat, coinciding, and within the zone of thickness of work 39. Therefore, with a work 39 below presser foot 19, i.e. during a sewing operation, driver 17 gets only very slightly disengaged from stop surface 18. In this way, due to the fact that during the periods of engagement of the presser foot with the work, the toggle mechanism 11 operates in the zone of its extended position, presser foot 19 can be engaged with and disengaged from work 39 gently,, irrespective of the adjusted amount of total lift of the presser foot.

The basic position of presser foot 19 can be adjusted to the thickness of work 39 by means of setting screws 32, i.e. by relatively displacing presser bar 16.

To lift presser foot 19 at the end of a sewing operation, air cylinder 29 is actuated. Piston rod 28 then moves presser bar 16 upwardly, through engaging member 27. Under the action of spring 22, stop surface 18 applies against driver 17 which, at the same time, is moved upwardly due to the hinged connection between crank lever 14 and arm 15 of presser bar 16, so that presser foot 19 is lifted through stop surface 18.

While a specific embodiment of the invention has been shown and described in detail to illustrate the application to the principles of the invention, it will be understood that the invention may be embodied otherwise without departing from such principles.

What is claimed is:

1. A presser foot arrangement for a sewing machine including a presser bar having a presser foot mounted thereon and movable upwardly and downwardly, spring means biasing said presser foot in a downward direction toward engagement with a workpiece and an eccentric drive connected to the sewing machine, the arrangement including a pivotal driver member engagable with the presser foot to raise the presser foot and being releasable from the presser foot to permit the presser foot to be biased into engagement with the workpiece, and a drive mechanism connected between said driver member and the eccentric drive and including a toggle mechanism made of at least two toggle members which are pivotably connected to each other and which have an extended position with said at least two toggle members substantially in line with each other, when said driver member is released from the presser foot and the presser foot is engaged with the workpiece.

2. A presser foot arrangement according to claim 1, wherein said drive mechanism includes a swing lever pivotally mounted in said sewing machine having one arm forming one of the toggle members.

3. A presser foot arrangement according to claim 2, wherein said driver member comprises a crank lever mounted on said presser bar and having a driver arm with a driver surface engageable with a surface of said presser foot.

4. In a sewing machine including a drive shaft, a presser foot carried by a presser bar and biased downwardly toward a workpiece, the improvement comprising a drive member pivotally mounted adjacent said presser foot and having a drive surface engageable with said presser foot to raise and lower said presser foot, a drive operated by the sewing machine drive shaft and connected to said drive member, said drive including a toggle mechanism which is in its extended position when said presser foot engages the workpiece, said toggle mechanism including at least two toggle members which are in substantial alignment with each other in said extended position, one of said toggle members having a first end pivotally connected to the other of said toggle members and a second end connected to the drive shaft for pivoting said one toggle member to move said toggle mechanism into said extended position.

5. In a sewing machine according to claim 4, including an actuator connected to said presser bar for moving said arm vertically upwardly and downwardly relative to said workpiece and spring means biasing said presser foot in a downward direction into engagement with the workpiece.

6. A presser foot operating mechanism for a sewing machine having a drive shaft to reciprocate a needle into and out of a workpiece, comprising a support plate having a bushing portion, a hollow presser bar mounted in said bushing for upward and downward movement, a presser foot having a guide rod portion movable upwardly and downwardly in said hollow presser bar and which has a stop surface, spring means in said hollow presser bar urging said presser foot downwardly, a crank member pivotally mounted on said presser bar and having a driver arm engageable with said stop surface to raise said presser foot upwardly and lift it off a workpiece and to permit advance of the workpiece, a double arm lever pivotally mounted on said support, drive means connected to the sewing machine and to said double arm lever to oscillate said lever, and a toggle mechanism connected between said double armed lever and said crank lever to oscillate said crank lever for raising and lowering said presser foot, said toggle mechanism being constructed so as to be in an extended position when said driver is disengaged from said stop surface.

7. A presser foot operating mechanism according to claim 6 including actuating means connected to said hollow presser bar to move it upwardly and downwardly between non-operative and operative positions.

8. A presser foot operating mechanism for a sewing machine having a drive shaft to reciprocate a needle into and out of a workpiece, comprising a support plate having a bushing portion, a hollow presser bar mounted in said bushing for upward and downward movement, a presser foot having a guide rod portion movable upwardly and downwardly in said hollow presser bar and which has a stop surface, spring means in said hollow presser bar urging said presser foot downwardly, a crank member pivotally mounted on said presser bar and having a driver arm engageable with said stop surface to raise said presser foot upwardly and lift it off a workpiece and to permit advance of the workpiece, a double arm lever pivotally mounted on said support, drive means connected to the sewing machine and to said double arm lever to oscillate said lever, and a toggle mechanism connected between said double armed lever and said crank lever to oscillate said crank lever for raising and lowering said presser foot, said toggle mechanism being constructed so as to be in an extended position when said driver arm is disengaged from said stop surface, actuating means connected to said hollow presser bar to move it upwardly and downwardly between non-operative and operative positions, and said actuating means comprises an air cylinder having a piston movable therein with an engaging member rod portion connected to said presser bar to raise and lower said bar, said spring means comprising a coil spring disposed in the hollow presser bar and adjusting means engageable with said spring for varying the tension of said spring.

9. A presser foot operating mechanism according to claim 8, including stop means engageable with said presser bar for limiting the downward movement of said presser bar.

10. A presser foot operating mechanism according to claim 9, including an eccentric connected to said main shaft, an eccentric bar engaged on said eccentric and connected to said double armed lever to oscillate said lever.

11. A presser foot operating mechanism according to claim 10, wherein said toggle mechanism is connected to an angle lever pivotally mounted on said support, a link member connected between one arm of said angle lever and one arm of said double armed lever and a second link connected between said angle lever and one arm of said crank lever.

12. In a sewing machine including a presser foot carried by a presser bar and biased downwardly toward a workpiece, the improvement comprising a drive member pivotally mounted adjacent said presser foot and having a drive surface engageable with said presser foot to raise and lower said presser foot, and a drive connection operated by the sewing machine and connected to said drive member, said drive connection including a toggle mechanism with a linkage which has an extended position when said presser foot engages the workpiece, an actuator connected to said presser bar for moving said presser foot vertically upwardly and downwardly relative to the workpiece and spring means biasing said presser foot in a downward direction into engagement with the workpiece, an adjusted stop for varying the vertical position of said presser bar, and adjustment means for adjusting the tension of said spring.

* * * * *